United States Patent [19]

Nakamura et al.

[11] Patent Number: 4,983,876

[45] Date of Patent: Jan. 8, 1991

[54] PIEZOELECTRIC PUMP ASSEMBLY

[75] Inventors: Satoshi Nakamura; Teruo Simizu; Reizo Naruse; Hiroyuki Igawa, all of Tokyo, Japan

[73] Assignee: Nippon Keiki Works, Ltd., Tokyo, Japan

[21] Appl. No.: 386,658

[22] Filed: Jul. 31, 1989

[30] Foreign Application Priority Data

Aug. 11, 1988 [JP] Japan ..... 63-200947

[51] Int. Cl.[5] ..... H01L 41/08

[52] U.S. Cl. ..... 310/328; 417/322

[58] Field of Search ..... 310/323, 328, 366; 417/322

[56] References Cited

U.S. PATENT DOCUMENTS 3,598,506 8/1971 O'Neill ..... 310/328 X
4,435,666 3/1984 Fukui et al. ..... 310/328
4,736,131 4/1988 Fujimoto ..... 310/328

FOREIGN PATENT DOCUMENTS 61-103580 7/1986 Japan .
62-159778 7/1987 Japan .

*Primary Examiner*—Mark O. Budd
*Attorney, Agent, or Firm*—Armstrong, Nikaido, Marmelstein, Kubovcik & Murray

[57] ABSTRACT

A piezoelectric diaphragm pump assembly is disclosed, wherein there is disposed a housing having an inlet port provided with a feed check valve, and an outlet port provided with a discharge check valve, wherein a casing is disposed for accomodating an amplification mechanism, said casing having an L-shape stationary member, to which a plate spring is fixed, a front end portion of the plate spring being fixed with a lever member of the amplification mechanism, which is engaged with an upper portion of a longitudinally effective type piezoelectric actuator, and wherein a diaphragm body coated with a film is disposed, characterized in that a front end portion of the lever member is fixed with a supporting member which is, in turn, fixed with a U-shape supporting member for supporting the diaphragm body, and that the supporting member is connected via a spring to the L-shape stationary member.

1 Claim, 9 Drawing Sheets

Fig. 10
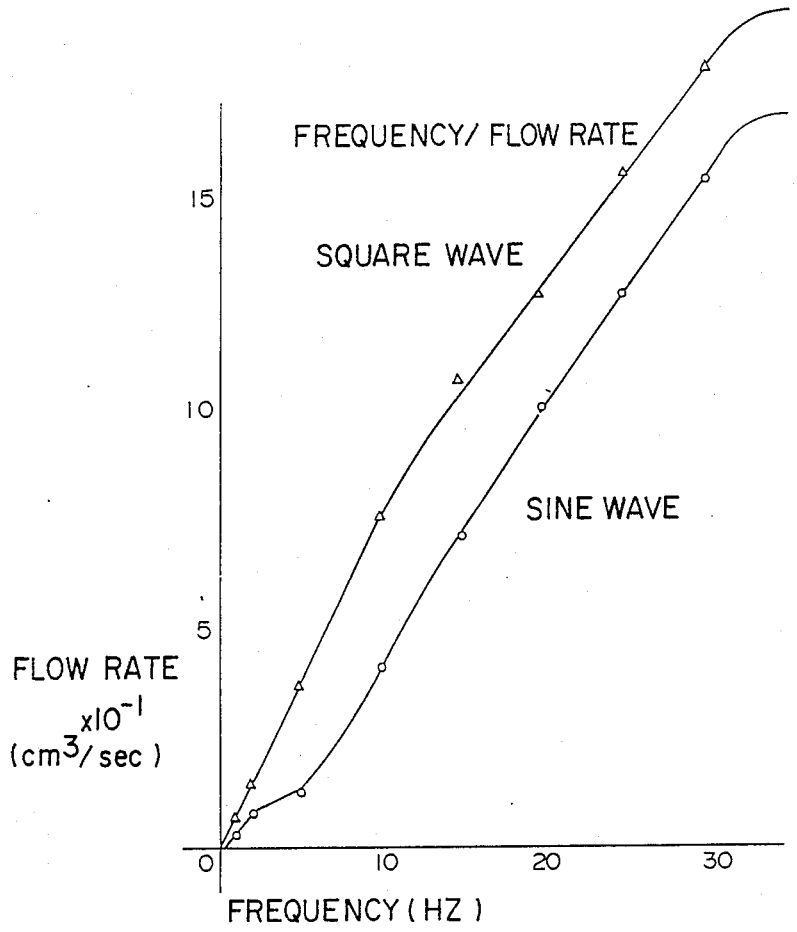
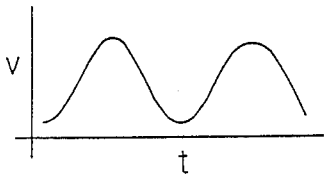
Fig. 11a
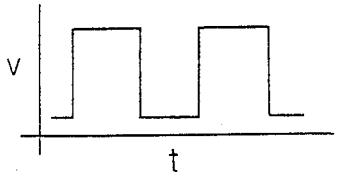
Fig. 11b
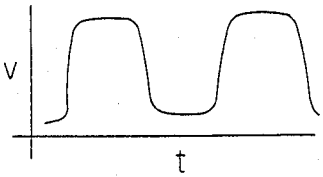
Fig. 11c
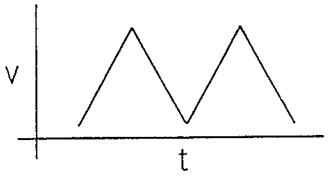
Fig. 11d
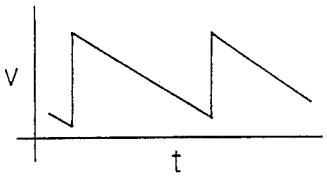
Fig. 11e
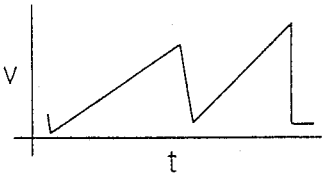
Fig. 11f

PIEZOELECTRIC PUMP ASSEMBLY

FIELD OF THE INVENTION

The present invention relates to a piezoelectric diaphragm pump assembly provided with a longitudinally effective type piezoelecteic acututor.

BACKGROUND OF THE INVENTION

As illustrated in FIG. 12, a known piezoelectric diaphragm pump assembly comprises an inlet port 39 with a ball valve 38, an outlet port 34 with a ball valve 38, and bimorphic type acutuators 36 and 37 at both sides of a pump room. When the actuators 36 and 37 are oscillated by applying an electric voltage to the actuator, then volume change of the pump room repeatedly occurs, so that the assembly acts as a pump means. In the bimorphic actuators 36 and 37, a large hysteresis is observed between the displacement and the electric voltage applied, and therefore there is no linear relationship between the displacement and the voltage, as shown in FIG. 13. In the experiment shown in FIG. 14, use was made of an actuator coated with a silicone rubber film.

Generally, a bimorphic actuator may oscillate at a frequency range near the resonance frequncy so that the flow rate is not proportional to the frequency employed. Furthermore, the bimorphic actuator shows a spherical displacement(a) as shown in FIG. 14, so that said acutuator is very poor with respect to the displacement and volume change.

Japanese Patent Application No. 159,778–1987, which was laid open on July 15, 1987, discloses a longitudinally effective type piezoelectric diaphragm pump provided with a piezoelecteic element with a small displacement. So, the flow rate of this pump is rather low.

Japanese Utility Model Application No. 103,580–1986, which was laid open on July 1, 1986, discloses a liquid pump with a plunger and with a lever for increasing the displacement. However, in the case of this pump, it is impossible to attain a high flow rate unless use is made of a diaphragm having a large diameter.

OBJECTS OF THE INVENTION

It is an object of the invention to provide a novel piezoelectric diphragm pump assembly, wherein a diaphragm body, having a film coated thereon, can oscillate in response to the action of a longitudinally effective type piezoelectric actuator, and wherein there is disposed an amplification mechanism which cam amplify the displacement of the actuator, so that the flow rate of the pump can be controlled by adjusting the voltage and frequency of the AC current applied to the actuator.

SUMMARY OF THE INVENTION

Therefore, the invention relates to a piezoelectric diaphragm pump assembly, wherein there is disposed a housing having an inlet port provided with a feed check valve, and an outlet port provided with a discharge check valve, wherein a casing is disposed for accomodating an amplification mechanism, said casing having an L-shape stationary memmber, to which a plate spring is fixed, a front end portion of the plate spring being fixed with a lever member of the amplification mechanism, which is engaged with an upper portion of a longitudinally effective type piezoelectric actuator, and wherein a diaphragm body coated with a film, is disposed, characterized in that a front end portion of the lever member is fixed with a supporting member which is in turn, fixed with a U-shape supporting member for supporting the diaphragm body, and that the supporting member is connected via a spring to the L-shape stationary member.

BRIEF DESCRIPTION OF THE DRAWINGS

FIG. 10 shows a graph illustrating the relationship between the frequency and the flow rate per 1 second of the pump assembly according to the invention.

FIG. 11 illustrates waves of AC which may be employed in the invention.

PREFERRED EMBODIMENTS OF THE INVENTION

The invention will be illustrated in detail by way of embodiments with reference to the drawings.

Figure 1:
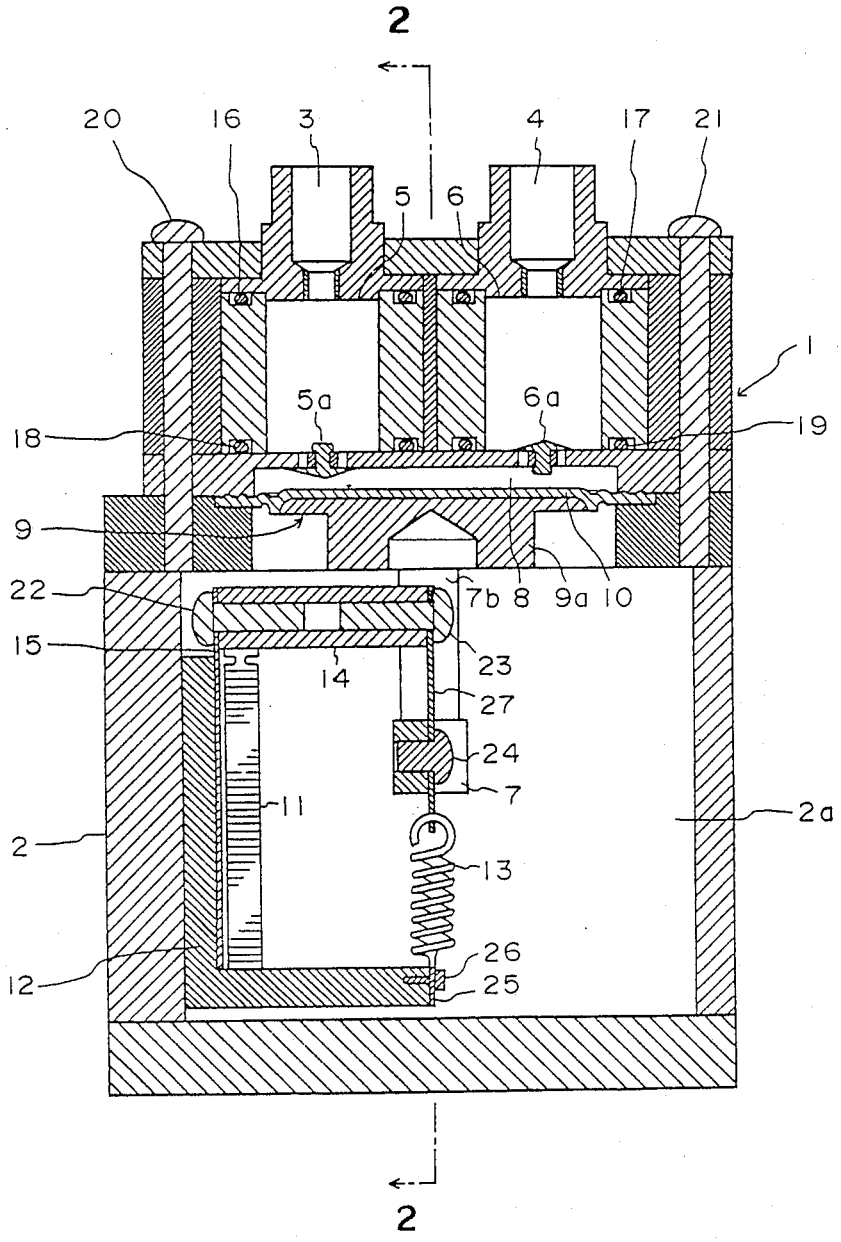
FIG. 1 is a longitudinal sectional view of a pump assembly according to the first embodiment of the invention.

FIG. 1 shows a longitudial sectional view of a pump assembly according to the first embodiment of the invention. The pump assembly comprises a housing 1, a diaphragm body 9, and a casing 2 which accomodates an amplification mechanism.

A inlet port 3 and an outlet port 4 are disposed at an upper portion of the housing 1. Under the inlet port 3, there is provided a hollow area 5 having a diameter somewhat larger than that of the inlet port 3. The bottom portion of the hollow area 5 is provided with an inlet check valve 5*a*.

Similarly, under the outlet port 4, there is provided a hollow area 6 having a diamater somewhat larger than that of the outlet port 4. The bottom portion of the hollow area 6 is provided with a dischage check valve 6*a*.

The diaphragm body 9 has a film 10 coated thereon. The film 10 consists of an elastic material such as rubber. There is a pump room 8, which is above the diaphragm body 9 and below the feed check valve 5a and the discharge check valve 6a.

Figure 3:
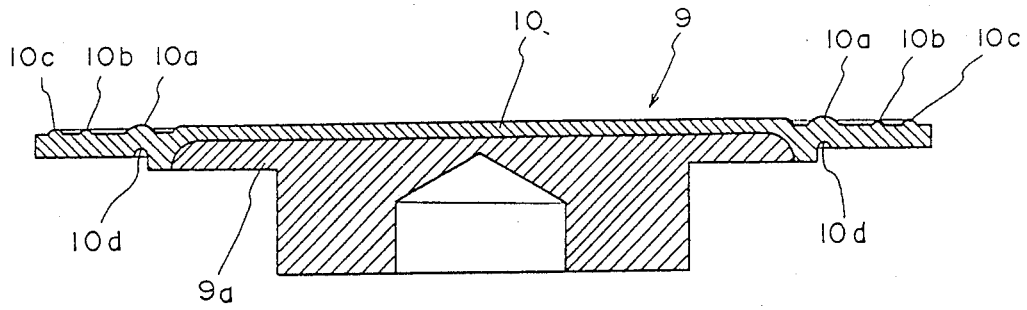
FIG. 3 is a longitudinal sectional view of a diaphragm body employed in the invention.

As explained above, the diaphragm body 9, which is employed according to the invention, has the film 10 coated on the surface of the substrate portion 9a of the diaphragm body 9, which is illustrated in more detail in FIG. 3. The film 10 is made of an stretchhable elastic material such as rubber. On the surface of the marginal portion of the film 10, there are formed a plurality of projections 10a, 10b and 10c. Furthermore, a recess 10d is formed on the rear surface of the marginal portion of the film 10.

Figure 4:
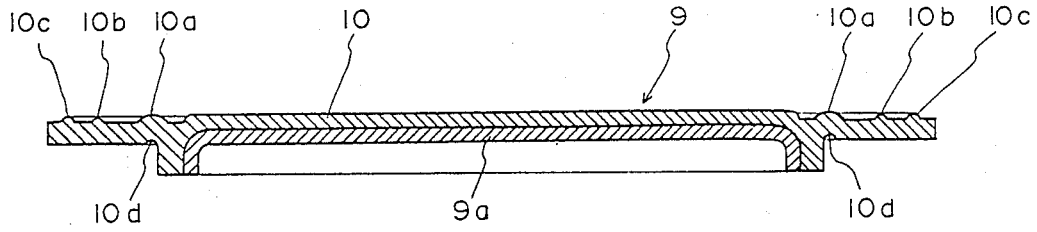
FIG. 4 is a longitudinal sectional view of another example of the diaphragm body.

FIG. 4 shows another example of the diaphragm body 9.

According to the 1 invention, the film member 10 of the diaphragm body 9 is provided at its marginal portion with the projections 10b and 10c, so that the whole portion of the dirphragm body 9 can be oscillated in parallel in the vertical direction in response to the oscillation of the actuator 11, and does not show any spherical displacement.

On the other hand, a known diaphragm comprises a single plate and show a spherical or conical displacement. Examples of such known diaphragms include a diaphragm consisting of a single metallic plate, and a diaphragm consting of a metallic plate coated with a film and having conical slits on the plate. These known diaphragms each are fixed at their marginal portions to a stationary menber. If the known diaphragms are oscillated, then they show either a spherical displacement(a) or a conical displacement(b).

Figure 9:
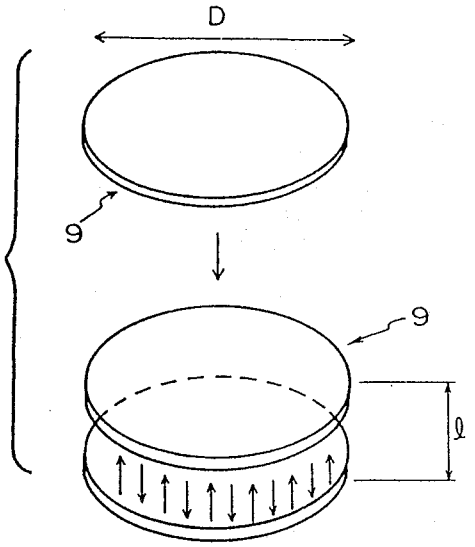
FIG. 9 is a schematic perspective view illustrating a parallel displacement of a diaphragm body employed in the invention.
Figure 12:
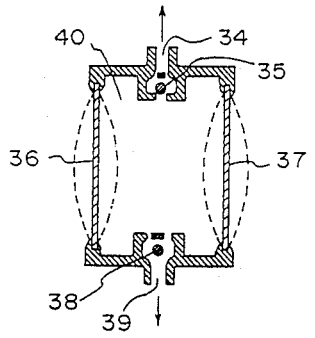
FIG. 12 is a schematic, longitudinal sectional view of a known bimorphic type piezoelectric diaphragm pump.
Figure 13:
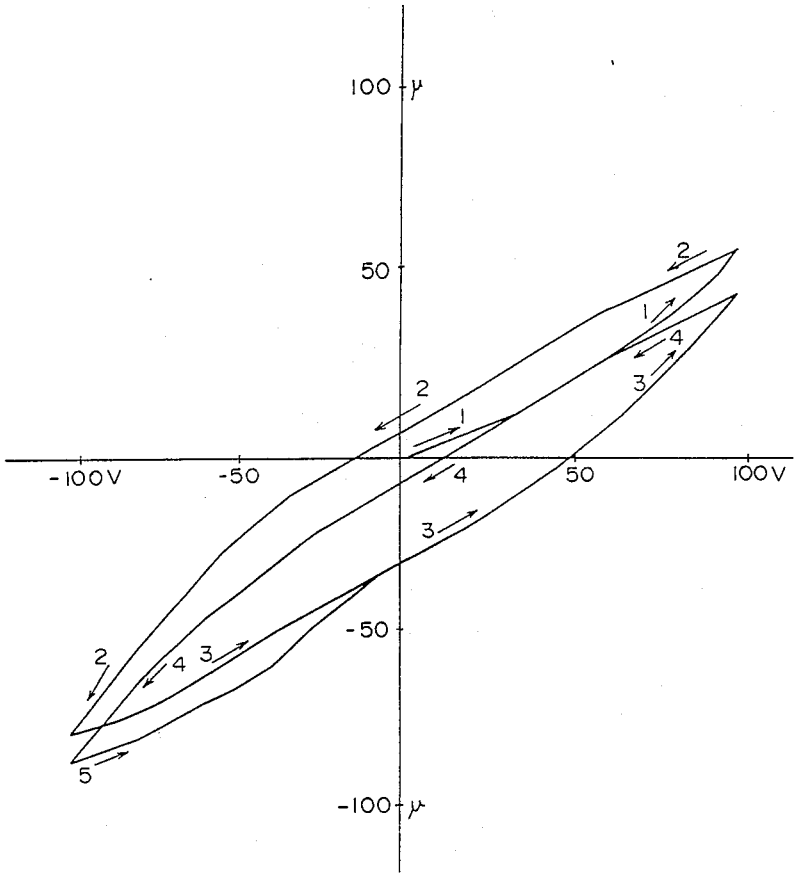
FIG. 13 shows a graph illustrating the relationship between the displacement and the DC voltage of a bimorphic type actuator according to a prior art.
Figure 14:
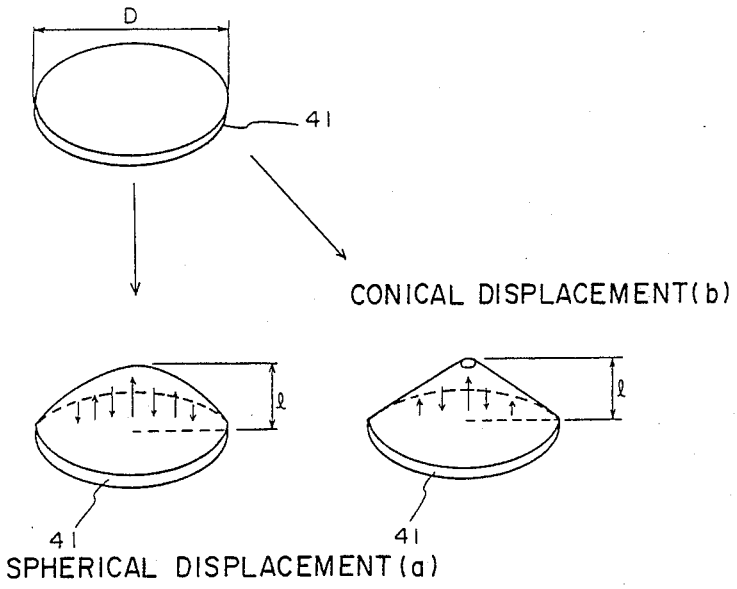
FIG. 14 is an explanatory view illustrating a spherical displacement and a conical displacement.

On the contrary, the diaphragm body 9 employed in the invention has an elastic film coated thereon, so that the whole portion of the diaphragm body 9 can ocsillate in parallel in the vertical direction as illustrated in FIG. 9. Therefore, the volume change rate of the pump room 8 amounts to $\frac{1}{4}\pi D^2 \times l$. (FIG. 9) The volume charge rate in the case case of the spherical displacement(a) amounts to $\frac{1}{4}\frac{1}{4}\pi D^2 \times l \div 2$ (FIG, 14) In the case of the conical displacement(b), the volume change rate amounts to $\frac{1}{4}\pi D^2 \times l \div 3$(FIG. 14).

When a longitudinally effective type actuator is used, it will be observed that a good linerity is maintained between the displacement and tha electric voltage applied. On the other hand, in the case of a bimorphic actuator, a poor linearity will be found between the displacement and the voltage.

The housing 1 is fixed to the casing 2 by means of bolts 20 and 21. In this embodiment, use is made of mushroom valves as the feed check valve 5a and as the discharge check valve 6a, although it is also possible to use other kinds of valves.

In the casing 2, a main body of amplification mechanism is disposed in the manner shown below.

Figure 2:
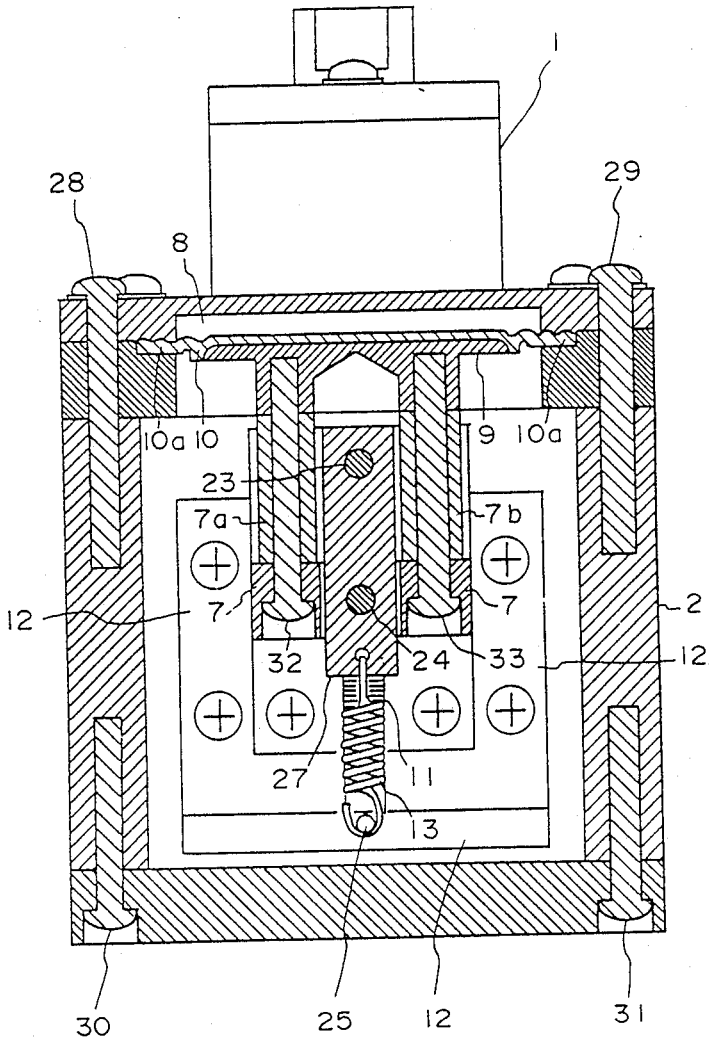
FIG. 2 is a longitudinal sectional view taken along the line A - B of FIG. 1.

As shown in FIGS. 1 and 2, a plate spring 15 is connected to an inner side of an L-shape stationry member 12.

An end portion of a longitudinally effective type actuator 11 is fixed to the L-shape stationary member 12, and the other end portion of the actuator 11 is connected to an inner side of a lever member 14. The lever member 14 is fixed to the plate spring 15 by means of a bolt 22. A supporting member 27 is fixed to the lever member 14 by means of a bolt 23, The front portion of the lever menber 14 is fixed with a U-shape supporting member 7, which has a left supporting part 7a and a right suppoting part 7b. The supporting member 27 is connected with a spring 13, which is, in turn, connected to a bolt 26 fixed to the L-shape stationary member 12.

FIG. 2 shows a logitudinally sectional view taken along the line A - B of FIG. 2, the supporting member 27, which supports the diaphragm body 9, is clearly illustrated. The diaphragm body 9 is fixed to the left supporting part 7a and to the right supporting part 7b of the U-shape supporting means 7.

Figure 5:
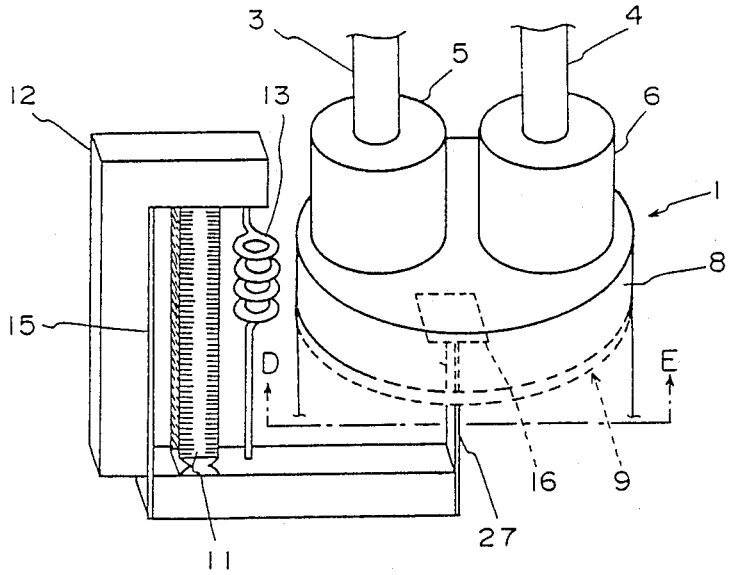
FIG. 5 is a schematic view of a main portion of a pump assembly according to the second embodiment of the invention.

FIG. 5 is a schematic partial view of a pump assembly according to the second embodiment of the invention, wherein the casing 2 for accomodating the amplification mechanism is disposed at the side of housing 1. According to the second emdobiment, including the lateral disposition of the amplification mechanism, it is possible to produce a compact pump assembly. The longitudinal sectional view of the housing 1 employed in the second embodiment may be the same as that shown in FIG. 1.

Figure 6:
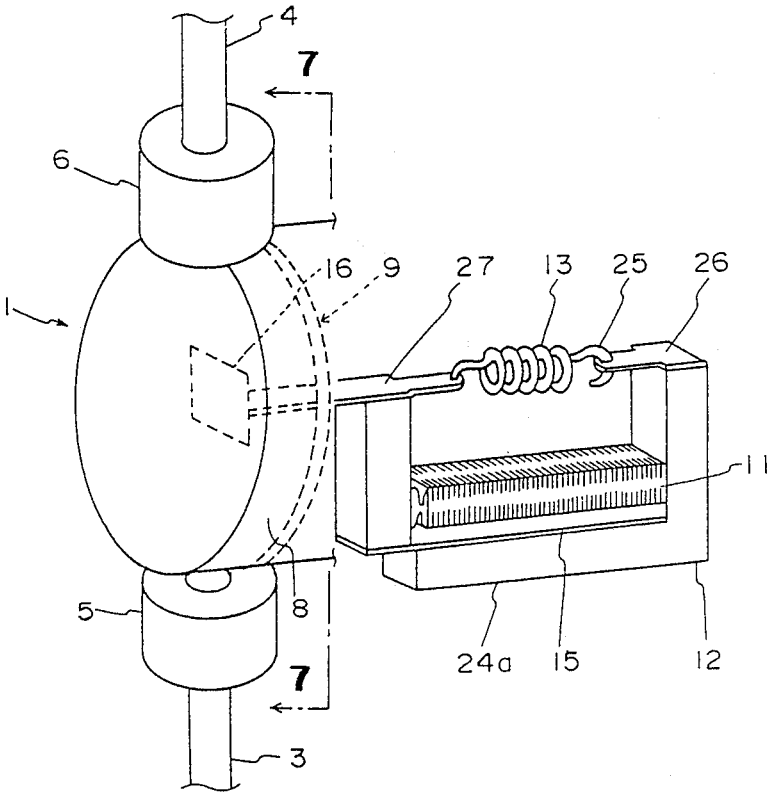
FIG. 6 is a schematic view of a main portion of a pump assembly according to the third embodiment of the invention.
Figure 7:
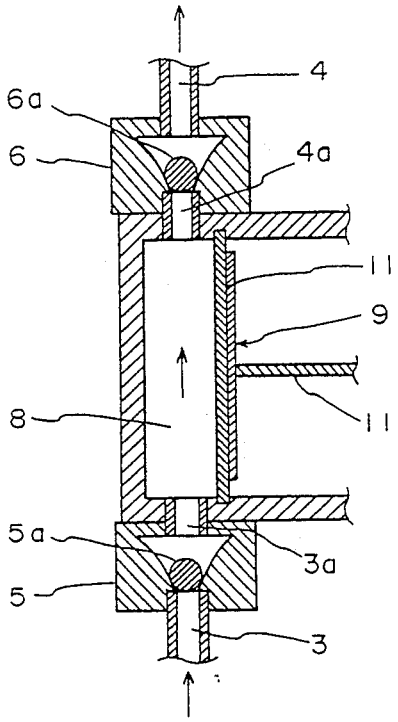
FIG. 7 is a longitudinal sectional view of a part of the pump assembly shown in FIG. 6

The third embodiment of the invention is illustrated in FIGS. 6 and 7. FIG. 6 is a schematic perspective view of a main portion of a pump assembly according to the third embodiment, and FIG. 7 is a longitudinal sectional view thereof.

According to the third embodiment, the inlet port 3 and the feed check valve 5 are disposed under the pump room 8 as shown in FIG. 7. A ball valve 5a is used as the check valve 5. The outlet port 4 and the discharge check valve 6 are disposed above the pump room 8. The check valve 6 is a ball valve 6a. The spring 13 has front end portion 25, which is connected via a spring-fixing member 27a to the L-shape stationary member 12.

Now, an explanation will be made about operation of the pump assembly according to the invention.

For instance, according to the first embodiment of the invention, there is provided the pump assembly which illustrated in FIGS. 1 and 2, wherein the longitudinally effectivetype piezoelectric actuator 11 is disposed. If an alternative current(which is mono-polar without negative polarity) is applied to the actuator 11, then the acutuator 11 oscillates in the vertical direction, and this vertical oscillation is amplified by means of a lever member 14 of the amplification mechanism.

The front emd portion of the lever member 14 is fixed with the supporting member 27 which is, in turn, connected to the U-shape supporting member 7 having the right supporting part 7b and the left supporting part 7a. The diaphragm body 9 is fixed to the suporting parts 7a and 7b, so that the diaphragm body 9 can oscillate in the vertiscal direction in response to the oscillaon of the acutuator 11.

When the diaphragm body 9 has moved to the lower position, then the internal area of the pump room 8 is kept under a negative pressure, the dischage check valve 6a is closed, and the feed check valve 5a is openned, so that the liquid to be pumped flows through the inlet port 3 and the hollow area 6 into the pump room 8.

When the diaphragm body 9 has moved to the upper position, then the pump room 8 is kept under a positive pressure, the feed check valve 5a is closed, the discharge check valve 6a is opened, so that the liquid is discharged from the pump room 8 through the hollow area 6 and the outlet port 4.

When the acutuator 11 contracts, it cannot exert any power. In other words, the acutuator 11 is weak to a tensile stress. In order to overcome this weakness, there is disposed the spring 13 which urges the U-shape supporting member 7 to move downwords. As explained above, the suction and the expulsion of the liquid are repeatedly conducted with the help of the vertical oscillation of the longitudinally effective type piezoelectric type piezoelectric acuator 11.

FIG. 5 shows the pump assembly according to the second embodiment of the invetion, which is different from the first embodiment only in that the amplification mechanism is disposed at the side of the housing 1. The action and effect of the pump assembly according to the second embodiment are virtually the same as those according to the first embodiment.

In the pump assembly according to the third embodiment shown in FIG. 6, the inlet port 3 and the feed check valve 5*a* are disposed under the housing 1, and the outlet port 4 and the discharge check valve 6*a* are disposed above the housing 1, so that the diaphragm body 9 can oscillate in the lateral direction. The effect of this pump assembly is substantially identical with that according to the first or second embodiment.

EFFECTS OF THE INVENTION

The invention has the features mentioned above, and therefore has an effect that the flow rate can be exactly controlled in a wide range from a very low rate to a high rate by a suitable adjustment of the frequency and the voltage.

Figure 8:
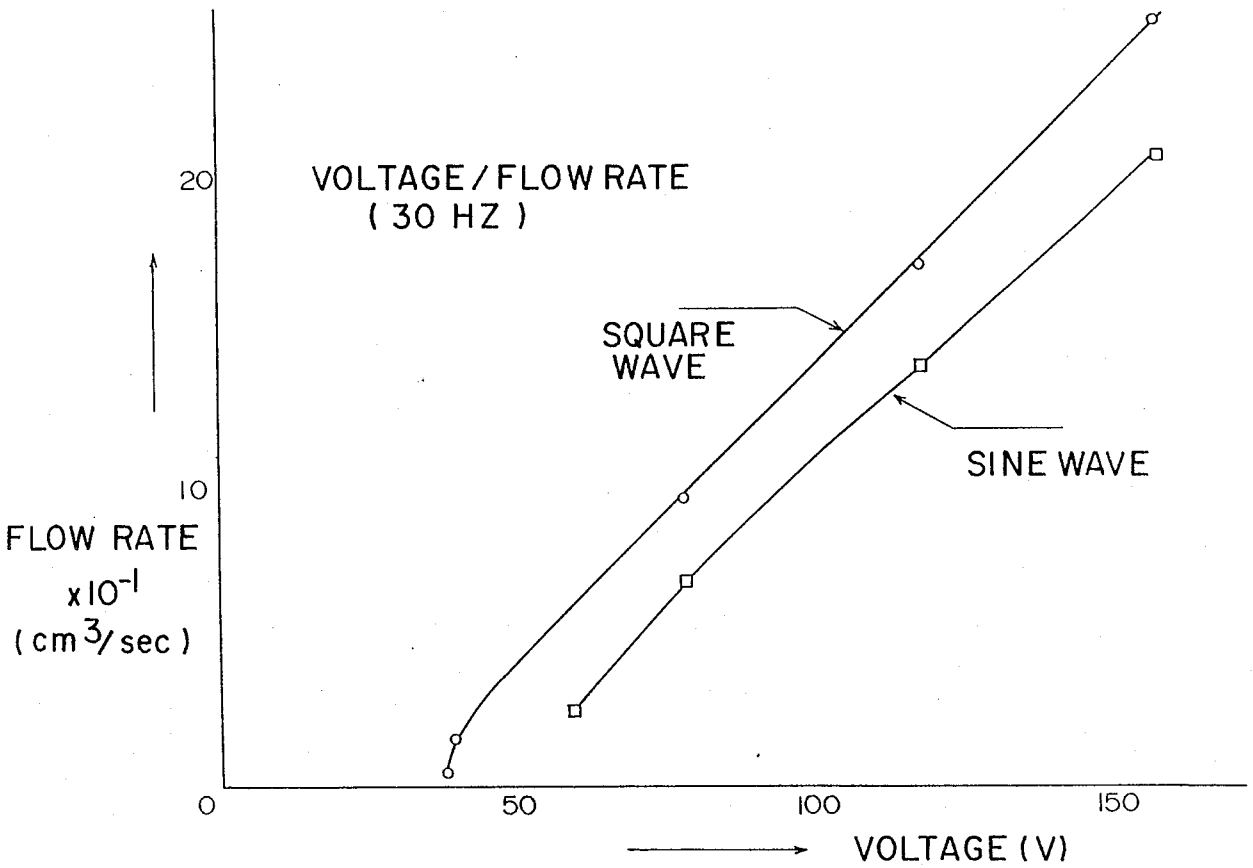
FIG. 8 shows a graph illustrating the relationship between the electric voltage applied and the flow rate per 1 second.

FIG. 8 shows a graph illustrating the relationship between the flow rate and electric voltage applied. FIG. 10 shows a graph illustrating the relationship between the flow rate and frequency of voltage applied. From these graphs, it will be observed that the flow rate changes with a change of the voltage or the frequency. Thus, according to the invention, the flow rate can be controlled with a high stability.

When an AC voltage, having a sine wave shown in FIG. 11(1), is applied, the pump assembly can be operated under a quiet condition.

If an AC voltage, having a square wave shown in FIG. 11(2), is applied, the pump assembly will be operated with an exact flow rate, although the assembly will make some noises.

It is also advantageous to apply an AC voltage having any of waves shown in FIGS. 11(3), (4), (5) and (6).

What is claimed is:

1. A piezoelectric diaphragm pump assembly, wherein there is disposed a housing having an inlet port provided with a feed check valve, and an outlet port provided with a discharge check valve, wherein a casing is disposed for accomodating an amplification mechanism, said casing having an L-shape statinary member, to which a plate spring is fixed, a front end portion of the plate spring being fixed with a lever member of the amplification mechanism, which is engaged with an upper portion of a longitudinally effective type piezoelectric actuator, and wherein a diaphragm body coated with a film is disposed, characterized in that a front end portion of the lever member is fixed with a supporting member which is, in turn, fixed with a Ushape supporting member for supporting the diaphragm body, and that the supporting member is connected via a spring to the L-shape stationary member.

* * * * *